United States Patent [19]

Wester

[11] Patent Number: 4,836,288

[45] Date of Patent: Jun. 6, 1989

[54] CASING HANGER AND PACKOFF RUNNING TOOL

[75] Inventor: Randy J. Wester, Spring, Tex.

[73] Assignee: FMC Corporation, Chicago, Ill.

[21] Appl. No.: 267,670

[22] Filed: Nov. 4, 1988

Related U.S. Application Data

[63] Continuation of Ser. No. 192,806, May 11, 1988, abandoned.

[51] Int. Cl.[4] ..... E21B 33/035; E21B 33/043; F16L 55/00

[52] U.S. Cl. ..... 166/348; 166/340; 166/341; 285/140

[58] Field of Search ..... 166/382, 348, 337, 338, 166/340, 341, 351, 368, 82, 88, 115, 116; 285/140, 139, 143

[56] References Cited

U.S. PATENT DOCUMENTS

| | | | |
|---|---|---|---|
| 3,353,596 | 11/1967 | Brown | 166/317 |
| 3,543,847 | 12/1970 | Haeber | 166/348 |
| 4,564,068 | 1/1986 | Baugh | 166/348 X |
| 4,611,663 | 9/1986 | Goris et al. | 166/382 |
| 4,634,152 | 1/1987 | Pettit | 285/140 X |
| 4,674,576 | 6/1987 | Goris et al. | 166/382 |
| 4,712,621 | 12/1987 | Wightman et al. | 166/348 X |
| 4,757,860 | 7/1988 | Reimert | 285/140 X |

*Primary Examiner*—Stephen J. Novosad

*Attorney, Agent, or Firm*—W. William Ritt, Jr.; Richard B. Megley

[57] ABSTRACT

A well tool for running, landing and setting a casing hanger and a packoff in a wellhead housing, and pressure-testing the integrity of the packoff seal, all in a single trip into the well.

14 Claims, 5 Drawing Sheets

CASING HANGER AND PACKOFF RUNNING TOOL

This application is a continuation, of application Ser. No. 192,806, filed May 11, 1988, now abandoned.

This invention relates to underwater well drilling equipment, and more particularly to running tools for installing casing hangers and packoffs in subsea or other underwater wellheads.

BACKGROUND OF THE INVENTION

During the course of drilling offshore wells from floating rigs or other water surface installations a common practice is to suspend the well casing strings from hangers supported in a wellhead housing at the floor of the sea or other body of water, and to pressure seal the annuli between the housing and the hangers by seal assemblies called packoffs. From earlier techniques involving running and installing a hanger and its packoff in separate round trips to the wellhead, the industry has developed tools and techniques for accomplishing the installation of both the hanger and its packoff in a single trip, thereby achieving significant savings in time and other expense. However, premature engagement of the packoff with the hanger, and obstruction of the packoff setting/sealing mechanisms by debris, have presented problems in use of these single trip tools and thus less than satisfactory results with their performance. The present invention was conceived and developed to overcome these problems, which it does in a novel and highly successful manner.

SUMMARY OF THE INVENTION

The present invention solves the foregoing problems associated with prior single trip casing hanger and packoff running tools by providing such a tool that retains the packoff in a retracted and fully locked position during hanger running, landing and cementing operations, thereby preventing premature engagement of the packoff in the hanger and/or passage of cement returns through or around the packoff sealing/setting mechanisms, yet facilitating correct positioning and setting of the packoff between the hanger and the wellhead housing in a straightforward, uncomplicated manner. The running tool of the present invention includes a central tubular mandrel surrounded by a tubular body and a casing hanger adapter sleeve, and a unique system of components which, though few in number as compared with previous tools for this drilling procedure, securely yet releasably hold the packoff in protected position on the tubular body until proper time for the landing and setting steps. The casing hanger adapter sleeve includes lower external threads by which it is releasably secured to the hanger, and upper internal threads which cooperate with an externally threaded area of the mandrel in a "ratch-a-latch" manner that releasably secures the adapter sleeve and mandrel together against relative axial movement yet permits the mandrel to be rotated and unthreaded from the sleeve for downward movement therein to install the packoff, and then returned to its earlier threaded position in the sleeve simply by lifting on the running string preparatory to retrieving the tool from the wellhead. The tool body is secured to the mandrel and thus moves rotationally and axially with it to land and set the packoff in response to rotation and lowering of the running string, and the body and adapter sleeve are also provided with special porting to conduct drilling mud or other fluids through the tool and so prevent accumulation of material in, and possible malfunction of, the packoff setting/sealing mechanisms.

The running tool of the present invention can be used to pressure/weight set or torque set the described packoff assembly, and the tool also can be employed to pressure test the blowout preventer stack, which usually is mounted directly on top of the wellhead, after the packoff has been set. The retracted and locked packoff retention features of the running tool allow the tool/packoff-/casing hanger assembly to be run into the wellhead in a fully retracted and locked condition, thereby avoiding possible interference within the rise and blowout preventer stack during insertion or retraction. This assures that the normal packoff sealing function occurs at, and only at, the proper time during the installation and setting procedure, i.e. after the casing has been cemented in the wellhead, and the packoff has been properly inserted in functional location between the hanger and the wellhead housing. Also, the retracted position of the packoff provides totally clear and adequate cement returns passage around, but not through, the packoff assembly during the cementing operation.

The running tool of this invention is mechanically disengaged and retrieved from the packoff and casing hanger after the packoff seal has been pressure tested satisfactorily. Controlled, sequenced rotation of the running tool achieves proper insertion of the packoff assembly into its functional position in the wellhead housing and subsequent withdrawal of the tool from the installed hanger for future use in additional drilling operations.

DESCRIPTION OF THE PREFERRED EMBODIMENT

Figure 1:
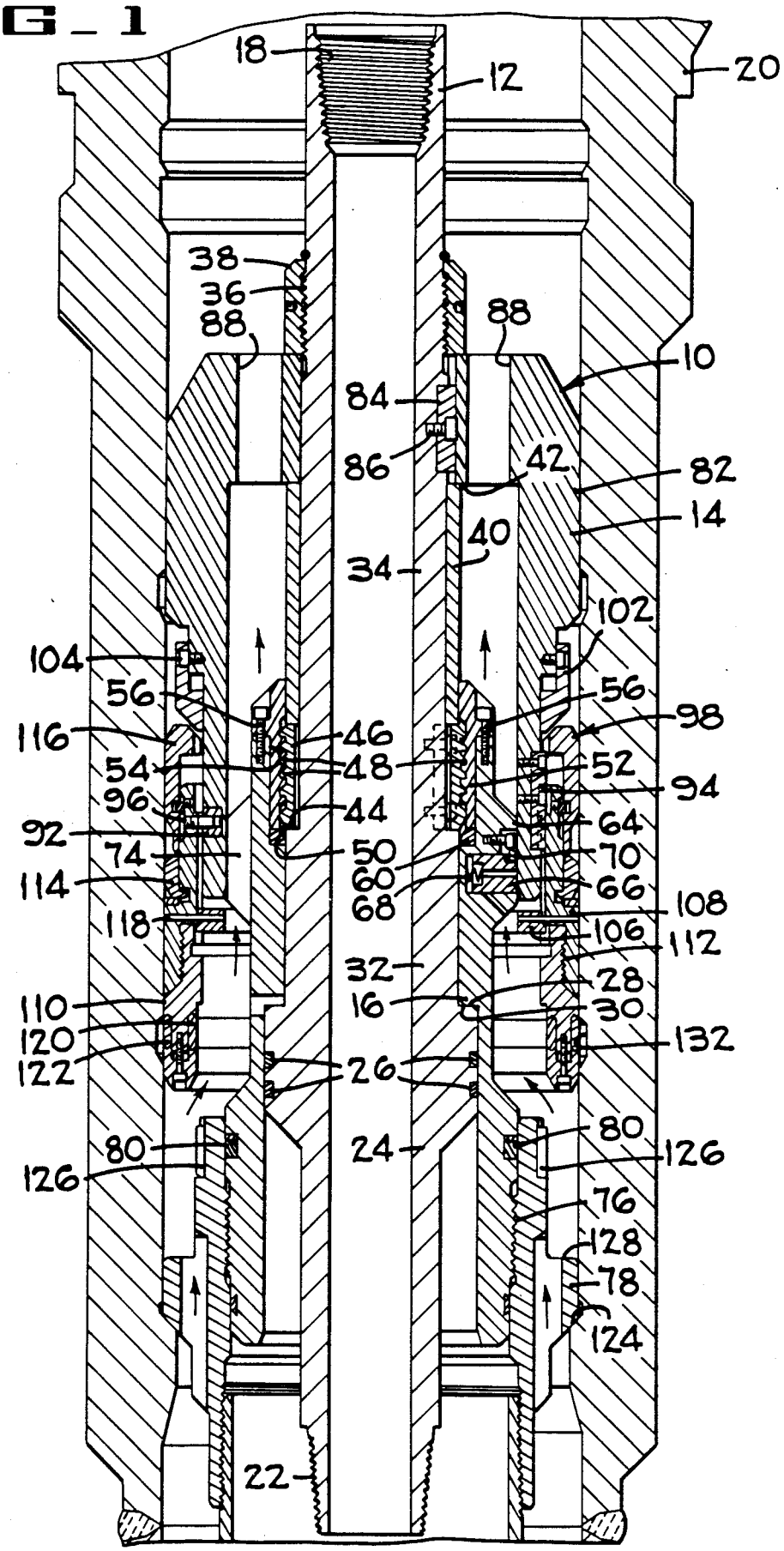
FIG. 1 is a view in central vertical section of a casing hanger and packoff running tool according to the present invention, showing a casing hanger and packoff installed on the tool in running position inside a wellhead housing and the hanger landed in functional location on an annular shoulder near the bottom of the housing, and by arrows the fluid flow direction through the tool.

As illustrated in FIGS. 1–4, the preferred embodiment of a casing hanger and packoff running tool 10 according to the present invention comprises a central tubular mandrel 12, a relatively large diameter body 14 surrounding the upper portion of the mandrel 12, and a casing hanger adapter sleeve 16 of intermediate diameter surrounding the lower portion of the mandrel. The mandrel 12 has upper internal threads 18 for attachment to a drill pipe string (not shown) for running the tool into, and retrieving it from, a wellhead housing 20, and lower external threads 22 for attaching the tool in another pipe or internally threaded element. Intermediate the ends of the mandrel 12 is an enlarged outer diameter portion 24 with one or more annular seals 26 (two shown) that establish a pressure barrier between the mandrel and the adapter sleeve 16, and the upper radial end surface 28 of the enlarged portion 24 functions as a stop shoulder in cooperation with an opposed radial stop shoulder 30 on the inner surface of the sleeve 16 to prevent relative axial movement of the mandrel and sleeve in one direction, so that the sleeve is supported on the mandrel but the mandrel can move downwardly within the sleeve.

Further up the mandrel 12 is a slightly reduced outer diameter portion 32, and above that is a further reduced outer diameter portion 34 with external threads at 36 on which is an internally threaded cap 38 that secures the mandrel against downward movement with respect to the body 14. A retainer sleeve 40 surrounds the mandrel 12 about the portion 34 and extends downwardly from a radial surface 42 on the body 14 towards the mandrel portion 32. Surrounding the mandrel portion 34 between the lower end of the sleeve 40 and the radial surface 44 extending between the portions 32, 34 is an axially-split contractable latch ring 46 with external threads 48 and an inwardly beveled annular cam surface 50 at its lower end. Thus the ring 46 is captured between the radial surface 44 and the retainer sleeve 40 and cannot move radially with respect to the mandrel 12, yet is free to contract from its inherently expanded condition (FIGS. 1 and 3) into its contracted condition (FIGS. 2 and 4) and vice versa.

The adapter sleeve 16 includes an internally threaded latch sleeve 52 residing in a counterbore 54 in the upper end of the sleeve 16, and a plurality (two shown) of circumferentially spaced bolts 56 secure the latch sleeve 52 to the adapter sleeve 16. Between the lower end of the latch sleeve 52 and an opposed radial surface 58 on the adapter sleeve 16 is a cam ring 60 with a downwardly and inwardly extending frusto-conical sufrace 62 that functions to cam the latch ring 46 from its expanded condition (FIGS. 1 and 3) into its contracted condition (FIGS. 2 and 4) as the mandrel 12 moves downwardly with respect to the body 14 during the packoff installation procedure as will be fully explained later.

The adapter sleeve 16 further includes an enlarged diameter portion 64 in which are located four circumferentially spaced tool retrieval keys 66 (only one shown), each of which is biased outwardly from the running tool centerline by a spring 68 and is retained in a lateral bore in the portion 64 by a retainer plate 70 and a capscrew 72. The enlarged portion 64 of the adapter sleeve also includes axially extending flow passages 74 (only one shown) spaced between the locations of the retrieval keys 66 for conducting drilling mud and other well fluids past the tool as it is being run into the well. The lower end portion of the adapter sleeve 16 has external threads 76 for releasable connection to a casing hanger 78, and annular seals 80 for establishing a fluid pressure barrier therewith.

The tubular body 14 of the running tool has an upper end portion 82 that extends inwardly to the outer surface of the tool mandrel 12 and is non-rotatably secured to the mandrel by a plurality of drive bars 84 (only one shown) that reside in axial slots in the mandrel and the body, and that are secured to the mandrel by capscrews 86. A plurality of flow passages 88 through the upper end portion 82 function to conduct drilling mud and other well fluids past the tool as it is being lowered into the well.

Figure 4:
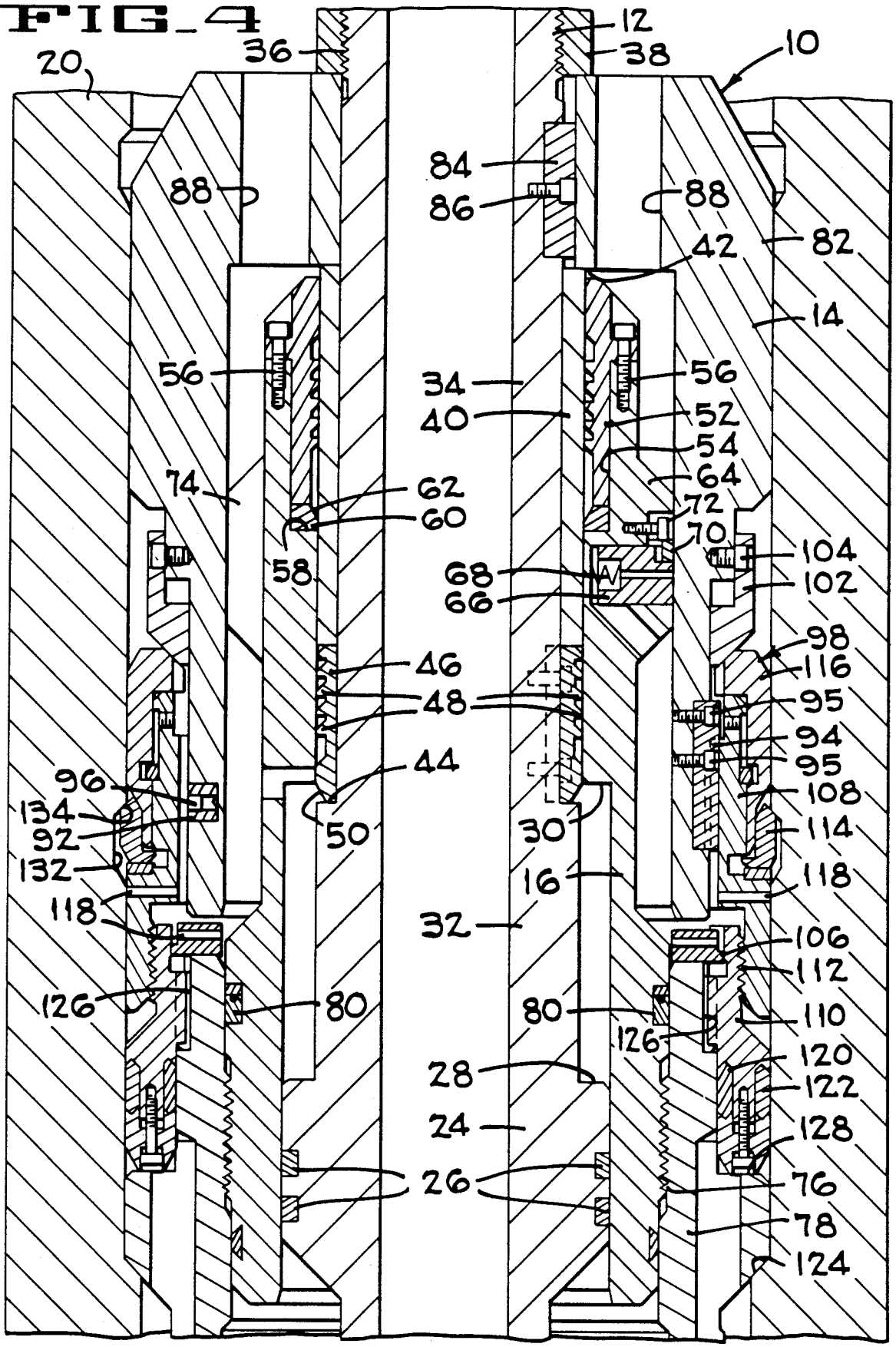
FIG. 4 is an enlarged fragmentary view of the central portion of FIG. 2.
Figure 5:
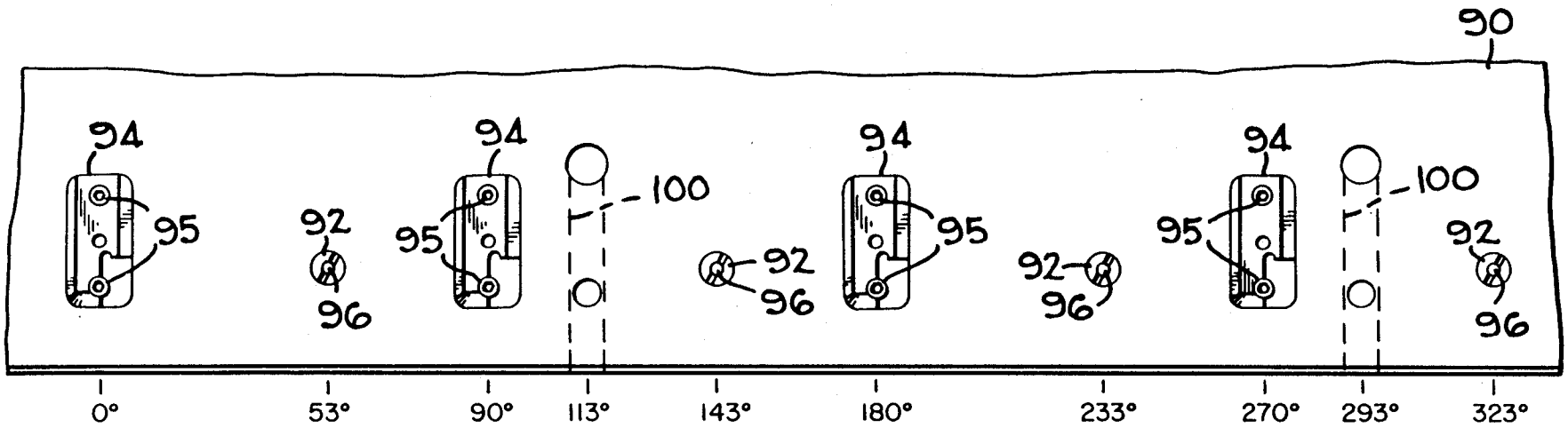
FIG. 5 is a fragmentary view taken around the entire circumference of just the running tool in the bracketed area of FIG. 3.

As illustrated best in FIG. 5, the lower portion 90 of the tool body includes four annular shear pads 92 and four packoff torque keys 94 circumferentially spaced around and secured to its external surface by capscrews 95, the shear pads accommodating shear pins 96 that serve to releasably attach a packoff assembly 98 to the body (FIGS. 1-4), and the torque keys functioning to transmit torque from the running tool to the packoff assembly 98 during the packoff setting step. The tool body also includes a pair of axial anti-rotation slots 100 spaced 180 degrees apart (FIG. 5) on its inner surface that cooperate with the tool retrieval keys 66 to transmit torque from the tool body to the adapter sleeve 16 when unthreading the sleeve from the casing hanger 78 during retrieval of the running tool 10 from the well. A shear ring 102 (FIGS. 1-4) surrounds the tool body 14 above the torque keys 94 and is releasably secured to the body by circumferentially spaced shear pins 104 which are sheared during pressure testing of the packoff seal, allowing the body to drop onto the packoff's anti-rotation ring 106 which, after setting the packoff, resides on top of the casing hanger 78.

Figure 2:
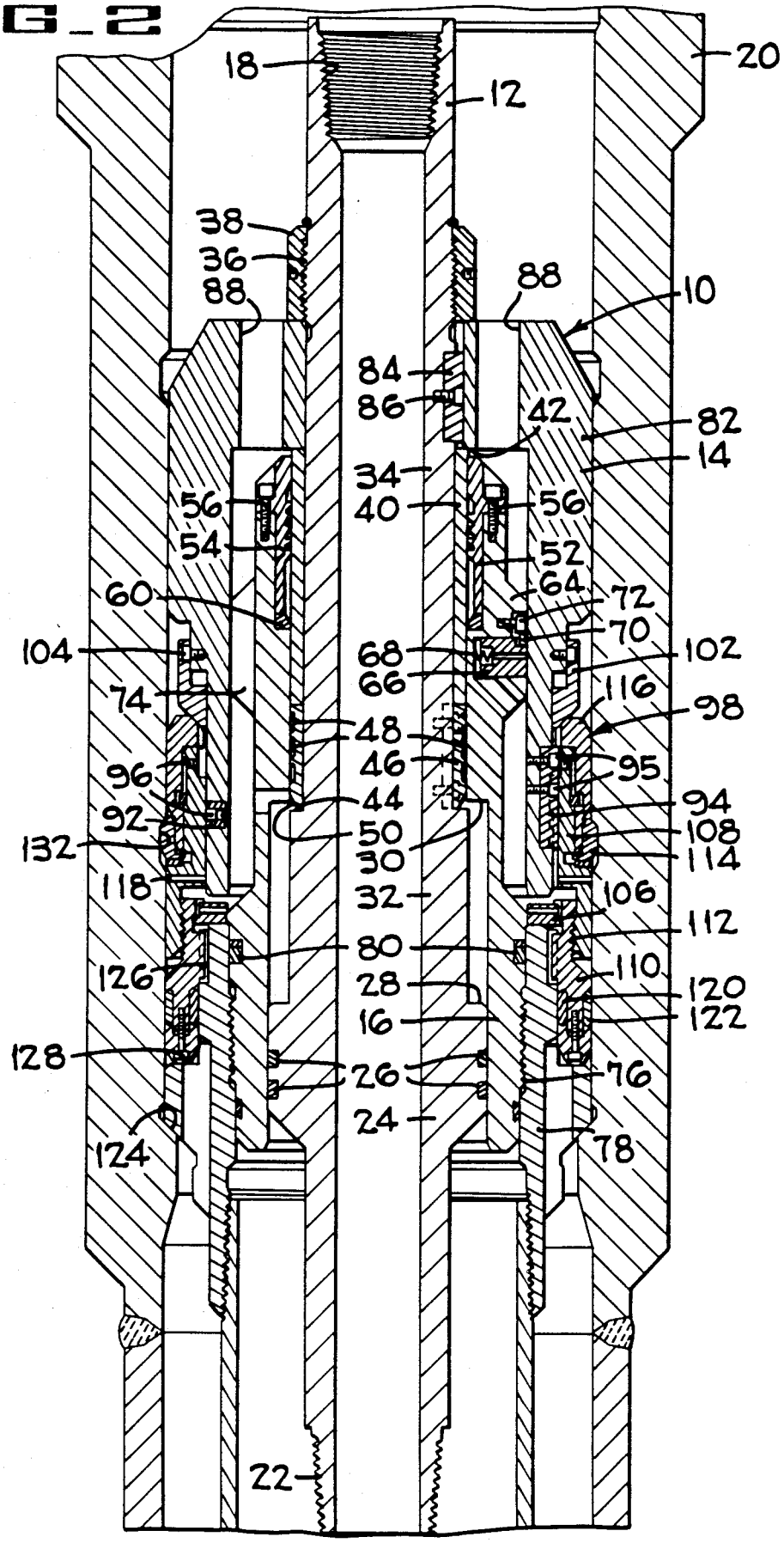
FIG. 2 is a view like FIG. 1, but showing the packoff installed and set in functional position between the hanger and the housing.

The illustrated annular packoff assembly 98 includes an upper body 108, a lower body 110 threaded to the upper body 108 at 112, a split, expandable lock ring 114 surrounding the upper body, an expander mandrel 116 surrounding the upper body above the lock ring 114, and an anti-rotation ring 106 that prevents relative rotation between the upper and lower bodies, and that is releasably secured to the upper body by circumferentially spaced shear pins 118. The lower body has inner and outer annular seal elements 120, 122 for establishing a fluid pressure seal with the adjacent surfaces of the casing hanger 78 and the wellhead housing 20, respectively, when the packoff is properly set in its functional position (FIGS. 2 and 4). As previously mentioned, a plurality of shear pins 92 function to releasably connect the packoff, through its upper body 108, to the running tool body 14, as seen best in FIG. 3.

CASING HANGER/PACKOFF INSTALLATION

Figure 3:
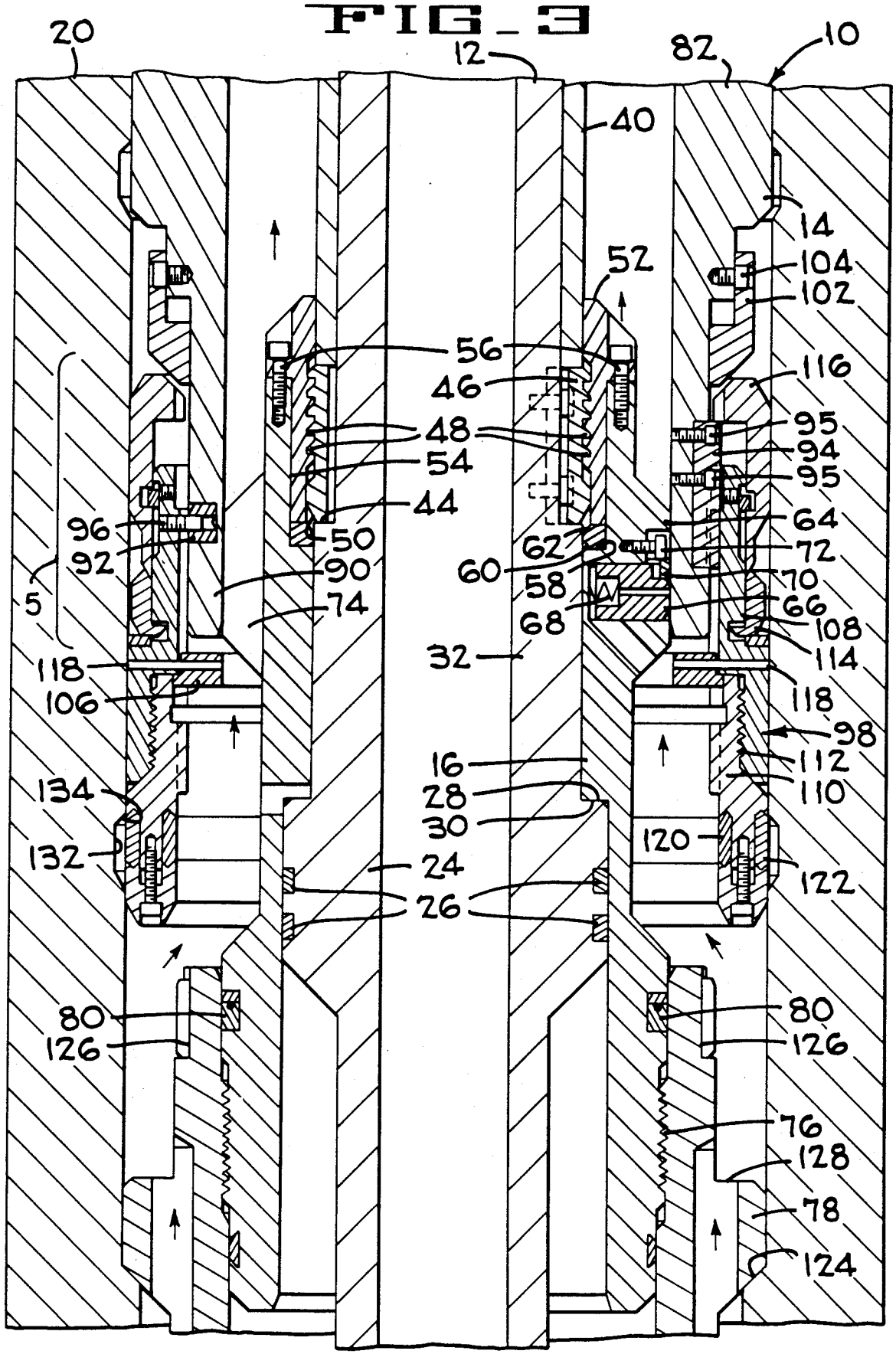
FIG. 3 is an enlarged fragmentary view of the central portion in FIG. 1.

The running tool 10, attached to a pipe string (not shown) and carrying the casing hanger 78 and packoff assembly 98 attached thereto as shown in FIGS. 1 and 3, is run into the wellhead housing 20 until the hanger comes to rest upon an annular shoulder 124 in the housing bore, and the hanger 78 and its casing string (not shown) are then cemented in the well-known manner. The pipe string is then rotated to the left, thereby likewise rotating the running tool mandrel 12, body 14 and packoff assembly 98 while the casing hanger adapter remains stationary (being threaded fully into the cemented hanger), until the latch ring 46 fully unthreads from the latch sleeve 52, whereupon the mandrel, body and packoff drop and the packoff lower body 110 keys into the casing hanger orienting groove 126 and continues down to land on the hanger shoulder 128, thereupon locking the packoff against rotation with respect to the hanger.

The pipe string is then rotated to the right, shearing pins 118 securing the packoff upper body 108 to the anti-rotation ring 106, whereby the ring falls out of contact with the upper body and comes to rest on top of the hanger 78, and allowing the upper body 108 to now rotate with respect to the lower body 110. As the foregoing rotation and descent occur, the running tool body 14 has forced the packoff expander mandrel 116 down inside the lock ring 114, expanding the ring into its mating groove 132 in the wellhead housing 20.

The pipe string is now further rotated to the right to torque the packoff upper body 108 with respect to the lower body 110 (which is locked in the hanger 78 and thus cannot rotate), seating the lock ring 114 against the upper frusto-conical shoulder 134 of the groove 132 and compressing the inner and outer packoff seals 120, 122 into tight contact with the hanger and housing surfaces, whereby the packoff is ready for pressure testing and locking to the wellhead housing.

TESTING THE PACKOFF ASSEMBLY

Once the packoff 98 has been installed and initially torqued to compress the seals 120, 122, the packoff is then pressure tested by full pressurization, which also fully sets the packoff seals between the casing hanger and wellhead housing. If the packoff seals test properly (i.e., no loss of pressure between the packoff, hanger and wellhead housing), the test pressure is released, and the packoff is retorqued to lock it in its final functional position.

Once the packoff has been properly installed and tested in the wellhead, the running tool may also be used to test the BOP stack prior to removal of the tool from the wellhead (optional).

RETRIEVAL OF THE RUNNING TOOL

The running tool 10 is removed from the wellhead housing 20 by pulling up on the pipe string to lift the mandrel 12 and body 14 with respect to the hanger adapter sleeve 16 until the mandrel shoulder 28 contacts the sleeve shoulder 30. As this upward movement occurs, the latch ring 46 is cammed inwardly as its threads engage the opposing threads on the latch sleeve 52, ratcheting into full engagement as shown in FIGS. 1 and 3.

The running tool is then rotated to unthread the hanger adapter sleeve 16 from the hanger 78, and the running tool then lifted out of the wellhead housing for repeated future use.

The above described invention includes the following inherent advantages over previous apparatus/practices used for casing hanger installation and packoff assembly sealing and testing in a wellhead.

(1) Using this running tool, the packoff is fully retracted and locking when going into the riser/BOP/-wellhead. Adequate flow passage/porting is provided in the tool for cement returns to bypass and not go through the packoff assembly during cementing.

(2) The packoff assembly is energized only upon command (rotation and pressure) from the surface drilling platform. Mechanical interlocks prevent the packoff from being inadvertently activated.

(3) Significantly increased reliability.

(4) The mechanical locking and sealing system allows multiple engagement, sealing test operations without any tool refurbishment on the deck of the drilling platform except replacement of packoffs and shear pins.

Although the best mode contemplated for carrying out the present invention has been herein shown and described, it will be apparent that modification and variation may be made without departing from what is regarded to be the subject matter of the invention.

What is claimed is:

1. A well tool for running and installing a casing hanger and a packoff into an underwater wellhead housing during a single trip into the well, comprising (a) a central tubular mandrel having means for attachment to a pipe string;

(b) a tubular body surrounding and secured to the mandrel for axial and rotational movement in unison therewith, said body including non-threaded means for releasably connecting it to a surrounding annular packoff;

(c) a casing hanger adapter sleeve surrounding the mandrel and partially surrounded by the body, said adapter sleeve releasably connected to the mandrel by a thread latching means which can be ratcheted from an unlatched condition into a latched condition without relative rotation between the mandrel and the sleeve, said sleeve including means for releasably connecting it to a well casing hanger for support thereof on the sleeve at a position beneath the packoff.

2. A well tool according to claim 1 including means for landing a packoff carried on the tubular body onto a casing hanger carried by the adapter sleeve, and means for setting said packoff in fluid pressure tight condition between said hanger and a surrounding surface of an outer well device.

3. A well tool according to claim 2 wherein said packoff setting means comprises at least one packoff torque key for rotation of one portion of a packoff with respect to another portion thereof.

4. A well tool according to claim 1 wherein the non-threaded means for connecting the body to a packoff comprises at least one shearable pin residing in opposed and aligned receptacles in said body and packoff.

5. A well tool according to claim 1 wherein the packoff is carried in a contracted and locked position on the tool during running thereof into the well.

6. A well tool according to claim 1 including fluid flow passages located in the tool to conduct drilling mud and other well fluids past a packoff assembly mounted on the tool in a flow path that avoids critical setting means of the packoff.

7. A well tool according to claim 1 wherein retrieval of the tool from the well can be accomplished solely by lifting the tool after it has been disconnected from a casing hanger.

8. A well tool for running and installing a casing hanger and a packoff into an underwater wellhead housing during a single trip into the well, comprising (a) a central tubular mandrel having means for attachment to a pipe string;

(b) a tubular body surrounding and secured to the mandrel for movement in unison therewith, said body including means for releasably connecting it to a surrounding annular packoff, (c) a casing hanger adapter sleeve surrounding the mandrel, said adapter sleeve releasably connected to the mandrel by latching means which can be ratcheted from an unlatched condition into a latched condition without relative rotation between the mandrel and the sleeve, said sleeve including means for releasably connecting it to a well casing hanger for support thereof on the sleeve.

9. A well tool according to claim 8 including means for landing a packoff carried on the tubular body onto a casing hanger carried by the adapter sleeve, and means for setting said packoff in fluid pressure tight condition between said hanger and a surrounding surface of an outer well device.

10. A well tool according to claim 9 wherein said packoff setting means comprises at least one packoff torque key for rotation of one portion of a packoff with respect to another portion thereof.

11. A well tool according to claim 8 wherein the means for connecting the body to a packoff comprises at least one shearable pin residing in opposed and aligned receptacles in said body and packoff.

12. A well tool according to claim 8 wherein the packoff is carried in a contracted and locked position on the tool during running thereof into the well.

13. A well tool according to claim 8 including fluid flow passages located in the tool to conduct drilling mud and other well fluids past a packoff assembly mounted on the tool in a flow path that avoids critical setting means of the packoff.

14. A well tool according to claim 8 wherein retrieval of the tool from the well can be accomplished solely by lifting the tool after it has been disconnected from a casing hanger.

* * * * *